US007011548B2

(12) United States Patent
Bogiel et al.

(10) Patent No.: US 7,011,548 B2
(45) Date of Patent: Mar. 14, 2006

(54) BOARD MOUNTED SIDE-ENTRY ELECTRICAL CONNECTOR

(75) Inventors: Steven B. Bogiel, Lisle, IL (US); Robert A. Owsley, Lisle, IL (US); Arvind Patel, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/825,846

(22) Filed: Apr. 16, 2004

(65) Prior Publication Data

US 2005/0233644 A1 Oct. 20, 2005

(51) Int. Cl.
*H01R 24/00* (2006.01)

(52) U.S. Cl. ..... 439/630; 439/79; 439/247; 439/856

(58) Field of Classification Search ..... 439/79, 439/947, 856–857, 248–251, 247, 630, 843
See application file for complete search history.

(56) References Cited

U.S. PATENT DOCUMENTS

| | | | | |
|---|---|---|---|---|
| 4,753,616 A | | 6/1988 | Molitor | 439/787 |
| 5,421,751 A | | 6/1995 | Bennett et al. | 439/843 |
| 5,431,576 A | | 7/1995 | Matthews | 439/247 |
| D372,220 S | | 7/1996 | Matthews | D13/133 |
| 5,556,286 A | * | 9/1996 | Ikesugi et al. | 439/74 |
| 5,599,192 A | * | 2/1997 | Olson | 439/65 |
| 5,618,187 A | * | 4/1997 | Goto | 439/79 |
| 5,630,720 A | | 5/1997 | Kocher | 439/78 |
| D405,417 S | | 2/1999 | Matthews | D13/147 |
| 5,915,979 A | | 6/1999 | Schell et al. | 439/83 |
| 6,089,929 A | | 7/2000 | Sloey | 439/845 |
| 6,095,827 A | | 8/2000 | Dukowsky et al. | 439/83 |
| 6,210,240 B1 | | 4/2001 | Comerci et al. | 439/853 |
| 6,383,039 B1 | | 5/2002 | Yoneyama et al. | 439/856 |
| 6,394,818 B1 | | 5/2002 | Smalley, Jr. | 439/79 |
| 6,402,525 B1 | | 6/2002 | Gugliotti et al. | 439/65 |
| 6,402,566 B1 | | 6/2002 | Middlehurst et al. | 439/699.1 |
| 6,604,967 B1 | | 8/2003 | Middlehurst et al. | 439/862 |
| 2001/0039154 A1 | | 11/2001 | Pierini et al. | 439/884 |
| 2002/0193019 A1 | | 12/2002 | Blanchfield et al. | 439/857 |

FOREIGN PATENT DOCUMENTS

FR 2 766 630 A1 1/1999

OTHER PUBLICATIONS

International Search Report, dated Jul. 14, 2005.

* cited by examiner

*Primary Examiner*—Michael C. Zarroli
(74) *Attorney, Agent, or Firm*—Stephen Z. Weiss

(57) ABSTRACT

A side-entry, blade-receiving electrical connector is provided for mounting on a printed circuit board. The connector includes a dielectric housing having a bottom wall and a blade-receiving receptacle at a side of the housing. At least one conductive terminal is mounted on the housing and includes a contact section exposed within the receptacle for electrically engaging a terminal blade of a complementary mating connecting device inserted into the side receptacle generally parallel to the printed circuit board. A mounting section is exposed exteriorly of the housing below the bottom wall thereof for mounting the connector on the printed circuit board. A flex section joins the mounting section to the contact section and performs a dual function of (a) spacing the bottom wall of the housing above the printed circuit board and (b) providing a yielding flexibility between the connector and the board.

29 Claims, 6 Drawing Sheets

BOARD MOUNTED SIDE-ENTRY ELECTRICAL CONNECTOR

FIELD OF THE INVENTION

This invention generally relates to the art of electrical connectors and, particularly, to a side-entry board mounted connector for use in various applications such as for receiving a terminal blade of a power connector.

BACKGROUND OF THE INVENTION

Various types of electrical connectors are designed for mounting on a printed circuit board. A typical board mounted connector includes some form of dielectric housing which mounts one or more conductive terminals. The terminals have terminating ends for connection to appropriate circuit traces on the board and contact ends on or in the housing for engagement with appropriate contacts or terminals of a complementary mating connector. The dielectric housing has a board-mounting end or face and a mating end or face which may have a receptacle, for instance, for receiving a mating end of the complementary mating connector.

One type of board mounted connector is a power (i.e., versus a signal) connector which couples power circuitry to and/or from power circuits on the printed circuit board. Such a power connector includes an elongated receptacle for receiving a flat blade terminal of a complementary mating power connector. In some instances, the receptacle is oriented in a direction generally perpendicular to the board for receiving a power terminal blade inserted into the receptacle generally perpendicularly toward the board. With such perpendicular connectors, there are minimal stresses on the connections to the board because the board, itself, absorbs most of the perpendicular forces.

However, some connectors of this type are "side-entry" connectors, in that the terminal blade is inserted into the connector's receptacle in a direction generally parallel to the board. With such side-entry connectors, considerable stresses, such as sheer stresses, occur at the board connections (which may be solder connections) and the connections often become damaged or broken, which results in defective power transmitting capabilities. It would be highly desirable to provide for some flexibility between the connector and the board to absorb some of the side forces generally parallel to the board, but this is not easily accomplished with many robust power connectors. The present invention is directed to solving these problems.

SUMMARY OF THE INVENTION

An object, therefore, of the invention is to provide a new and improved side-entry board mounted electrical connector.

Another object of the invention is to provide a new and improved connector of the character described which is a power-type connector which receives a terminal blade of a complementary mating connector.

In the exemplary embodiment of the invention, the connector includes a dielectric housing having a bottom wall and a blade-receiving receptacle at a side of the housing. At least one conductive terminal is mounted on the housing and includes a contact section exposed within the receptacle for electrically engaging a terminal blade of a complementary mating connecting device inserted into the side receptacle generally parallel to a printed circuit board. The terminal includes a mounting section exposed exteriorly of the housing below the bottom wall thereof for mounting the connector on the printed circuit board. A flex section of the terminal joins the mounting section to the contact section and performs a dual function of (a) spacing the bottom wall of the housing above the printed circuit board and (b) providing a yielding flexibility between the connector and the board.

According to one aspect of the invention, the conductive terminal is stamped and formed of sheet metal material. The mounting section of the terminal is a plate-like member for flush mounting on a surface of the printed circuit board. The flex section comprises a generally right-angled bend in the terminal between the plate-like mounting section and the contact section.

According to another aspect of the invention, the contact section of the conductive terminal is generally U-shaped in a cross-section generally parallel to the printed circuit board. The U-shape defines a pair of legs joined by a curved bight portion. One leg is connected to the mounting section of the terminal. The other leg forms a contact portion of the terminal which engages the terminal blade of the mating connecting device. The one leg of the U-shaped contact section is a plate-like member in abutment with the housing. The other leg forms a contact arm which is free to flex toward and away from the one leg. The contact arm has a plurality of flexible spring fingers for engaging the terminal blade of the mating connecting device. The contact arm has latch means for securing the terminal to the housing, the latch means being spaced inwardly from the flexible spring fingers.

Other features of the invention include the bottom wall of the housing being recessed in an area immediately above the mounting section of the conductive terminal to accommodate flexing of the housing relative to the subjacent circuit board. The blade-receiving receptacle is a through passage in the housing extending generally parallel to the printed circuit board for receiving a terminal blade of a mating connecting device in either opposite direction of the through passage. The housing has at least one anti-overstress wing projecting outwardly therefrom above the printed circuit board to prevent over-flexing of the conductive terminal. As disclosed herein, a pair of the conductive terminals are provided at opposite sides of the blade-receiving receptacle for engaging opposite sides of the terminal blade of the mating connecting device therebetween.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
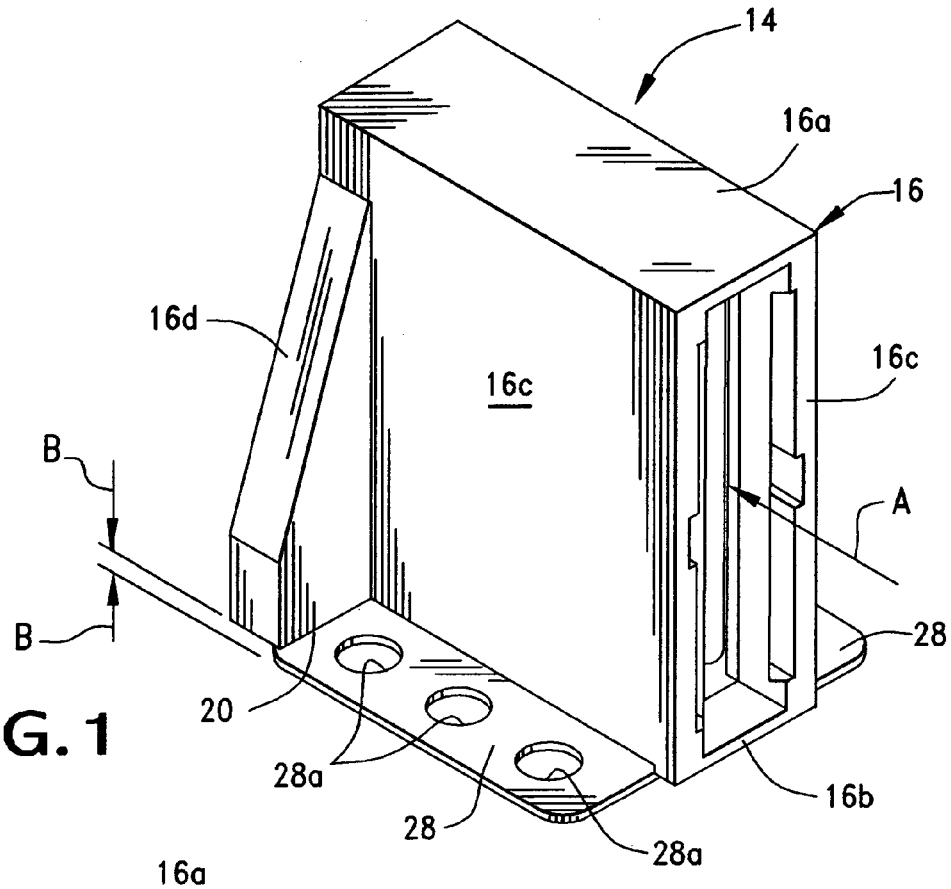
FIG. 1 is a top perspective view of a first embodiment of a side-entry board mounted blade-receiving electrical connector embodying the concepts of the invention.
Figure 2:
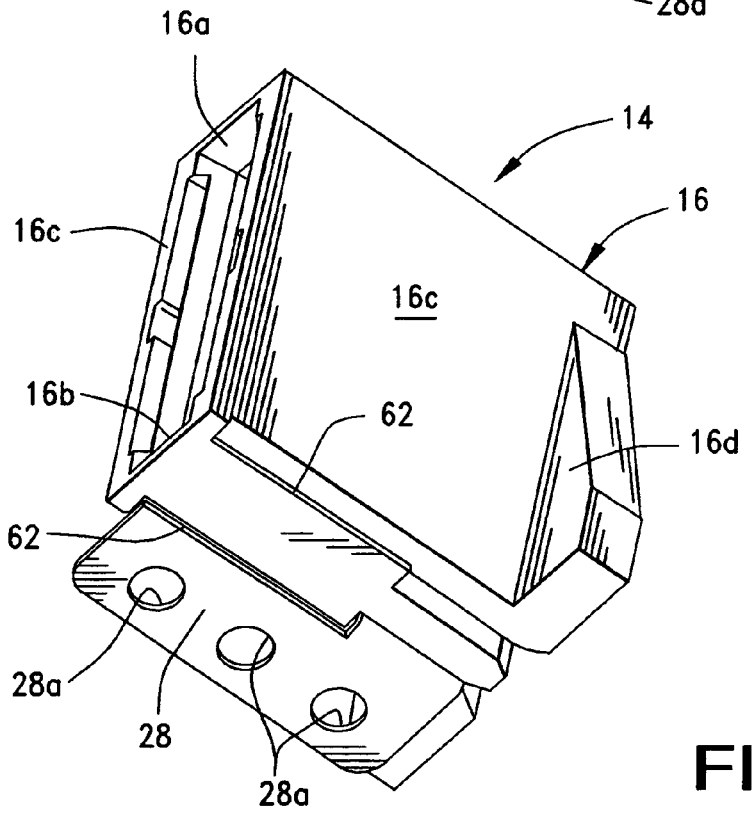
FIG. 2 is a bottom perspective view of the connector, with one of the terminals removed.
Figure 3:
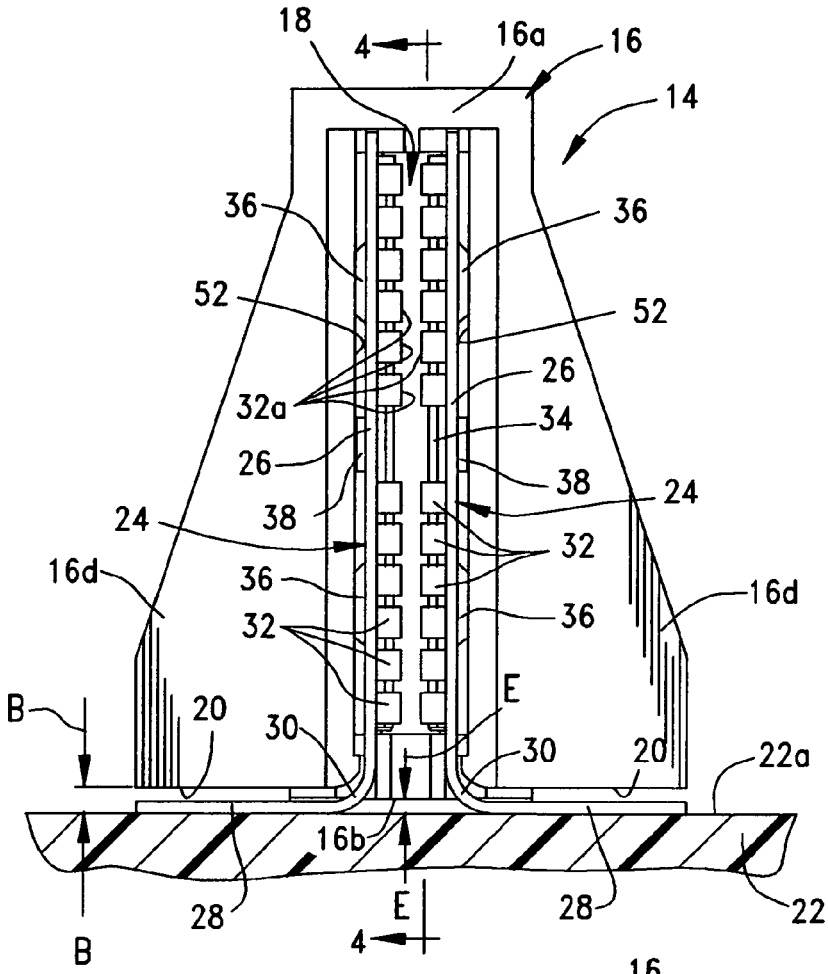
FIG. 3 is a side elevational view of the connector, looking at the through receptacle thereof.

Referring to the drawings in greater detail, and first to FIGS. 1–3, a first embodiment of the invention is incorporated in a side-entry board mounted blade-receiving electrical connector, generally designated 14. The connector is designed for mounting on a printed circuit board and for receiving a flat terminal blade of a complementary mating connector or other connecting device (not shown). Blade receptacles and blade connectors are used extensively as power connectors to couple power (i.e., versus signals) to circuit traces on the circuit board. The features of the invention, such as using the terminals, themselves, to space the connector housing above the circuit board as described hereinafter, are equally applicable for use with other types of connectors or connector assemblies.

With that understanding, connector 14 includes a dielectric housing, generally designated 16, which is generally rectangular and box-shaped as seen in FIGS. 1 and 2. The housing may be a one-piece structure unitarily molded of dielectric plastic material or the like. The box-shaped housing includes a top wall 16*a*, a bottom wall 16*b* and a pair of side walls 16*c* which form a blade-receiving, through passage or side-entry receptacle, generally designated 18 and best seen in FIG. 3. With bottom wall 16*b* of the housing facing a printed circuit board to which the connector is mounted, the term "side-entry" means that the receptacle receives a blade terminal in a direction generally parallel to the circuit board as indicated by arrow "A" in FIG. 1. Details of the interior of the receptacle will be described hereinafter. As seen in all of FIGS. 1–3, housing 16 includes a pair of integral, anti-overstress wings 16*d* which extend outwardly from opposite side walls 16*c*. Arrows "B" in FIGS. 1 and 3 show that a bottom surface 20 of wings 16*d* are spaced above a top surface 22*a* (FIG. 3) of a printed circuit board 22 when connector 14 is mounted to the board.

Figure 5:
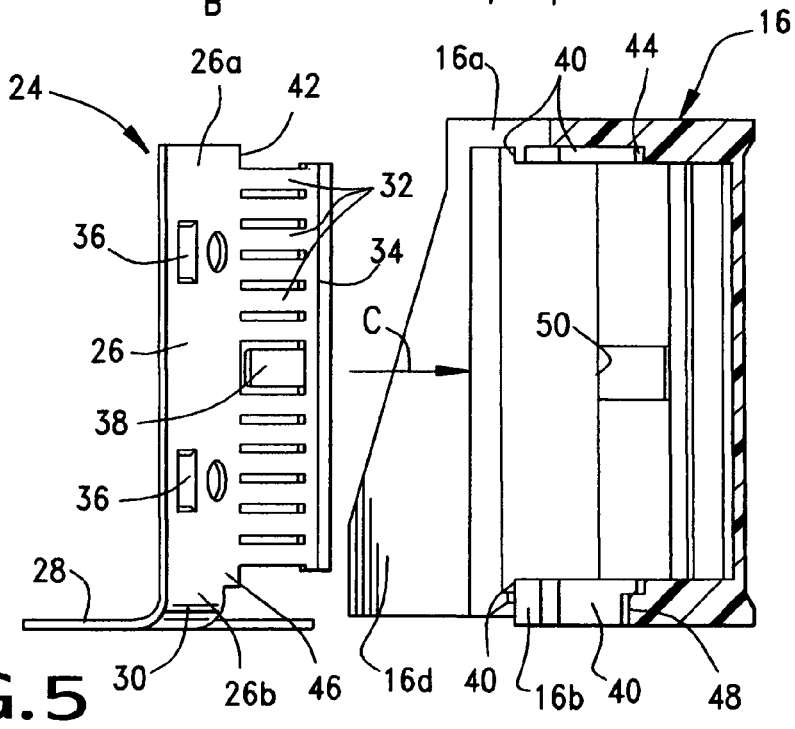
FIG. 5 is a view similar to that of FIG. 4, but with the terminal removed from the housing.
Figure 4:
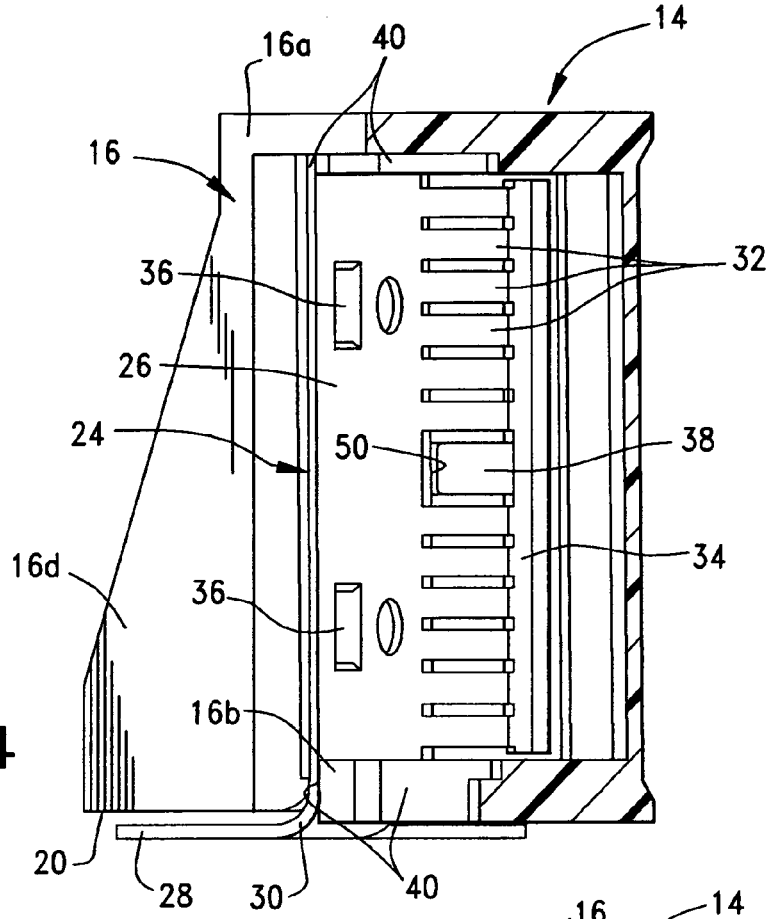
FIG. 4 is a sectioned perspective view looking generally in the direction of line 4—4 of FIG. 3.

Referring to FIGS. 4 and 5 in conjunction with FIGS. 1–3, side-entry connector 14 includes a pair of conductive terminals, generally designated 24, which are mounted in housing 16 at opposite sides of blade-receiving receptacle 18. Each terminal includes a contact arm or contact section 26 which, at least in part, is exposed within receptacle 18 for electrically engaging the terminal blade of the complementary mating connector. Each terminal includes a mounting section 28 which is exposed exteriorly at the bottom of housing 16 below bottom wall 16*b* for mounting the connector on top surface 22*a* of printed circuit board 22 as seen clearly in FIG. 3. A flex section 30 joins mounting section 28 to contact arm or section 26 of each terminal 24. The flex section performs a dual function of spacing bottom wall 16*b* of the housing above the printed circuit board as seen in FIG. 3, and also providing a yielding flexibility or floating movement between the connector and the board.

More particularly, each terminal 24 may be stamped and formed of conductive sheet metal material. Mounting section 28 is a plate-like member for flush mounting on surface 22*a* of circuit board 22 as seen in FIG. 3, and the plate-like members of the two terminals may be soldered to power circuit traces on the board, as by soldering, with the plate-like members having apertures 28*a* to add "edges" to the mounting sections about which the solder material can flow. Each terminal is generally L-shaped, whereby flex section 30 forms a generally right-angled bend between mounting section 28 and contact section 26.

Contact arm or section 26 of each terminal 24 is a plate-like member which has a plurality of flexible, spring contact fingers 32 projecting into receptacle 18 as seen in FIG. 3, with the distal ends of the spring contact fingers joined by a cross bar 34 as seen in FIGS. 4 and 5. In essence, the spring contact fingers are stamped and formed out of the plane of the contact section so that they bow inwardly and present contact surfaces 32*a* as seen in FIG. 3 for engaging opposite sides of the terminal blade of the complementary mating connector. For purposes described below, contact section 26 of each terminal 24 has a pair of abutment bosses 36, along with a flexible latch tab 38.

Referring to FIGS. 4 and 5 particularly in conjunction with FIG. 3, terminals 24 are inserted into a pair of grooves or slots 40 in the insides of top and bottom walls 16*a* and 16*b*, respectively, of the housing. The top and bottom □ends□ 26*a* and 26*b*, respectively, of contact section 26 (as seen in FIG. 5) are insertable into slots 40 in the top and bottom walls, respectively, of the housing in the direction of arrow "C" (FIG. 5). When fully inserted, a stop shoulder 42 at end 26*a* of the contact section abuts against a stop shoulder 44 of housing 16 within the respective slot 40. A step-shaped abutment stop 46 at bottom end 26*b* of the contact section abuts against a step-shaped abutment shoulder 48 of housing 16 within the bottom slot 40. It should be understood that FIGS. 4 and 5 are sections taken through the slot for the terminal which is not shown in the depictions.

When terminal 24 is fully inserted into its respective slot 40, flexible latch tab 38 snaps into latching engagement with a latch shoulder 50 formed in the inside of the adjacent side wall 52 (FIG. 3) of receptacle 18. Abutment bosses 36 engage the side walls to provide a tight fit of the terminals in the housing and to prevent any "rattling" of the terminals.

Figure 6:
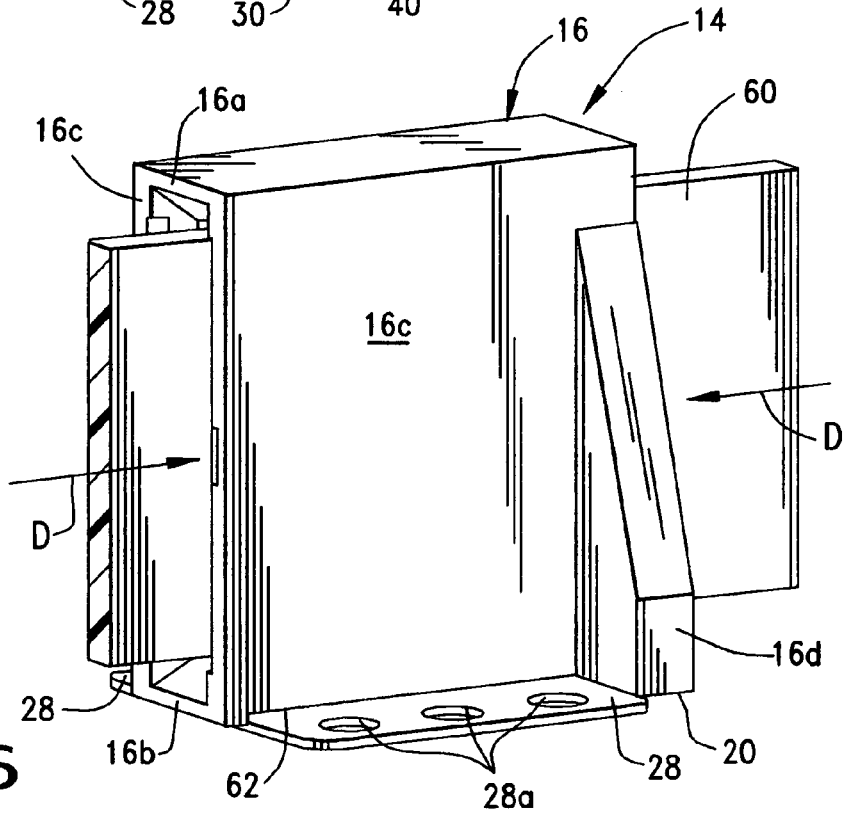
FIG. 6 is a perspective view of the connector, showing a blade extending completely through the receptacle of the connector.
Figure 7:
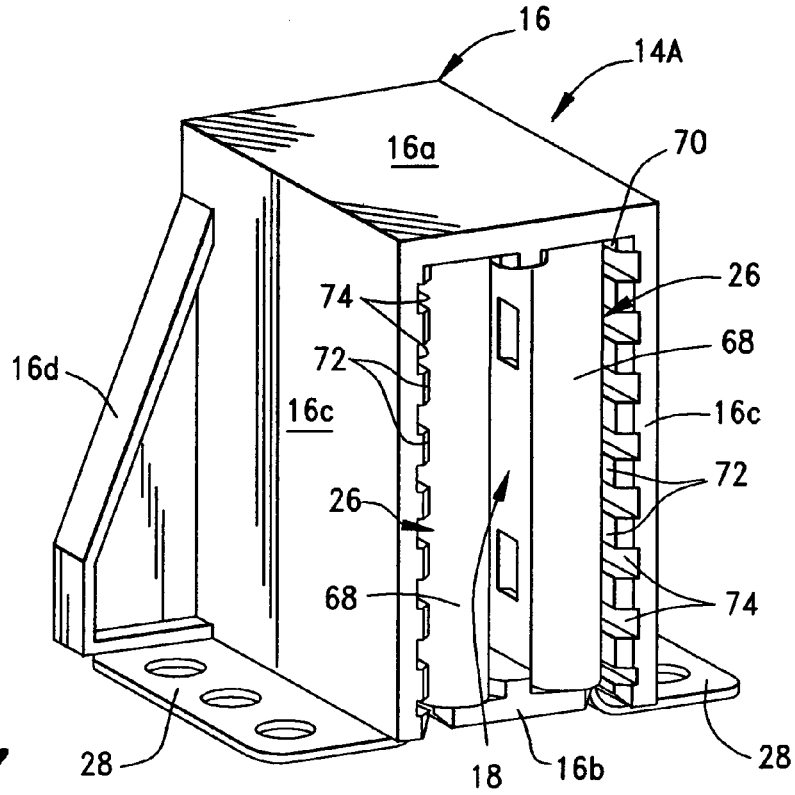
FIG. 7 is a view similar to that of FIG. 1, but of a second embodiment of the invention.

FIG. 6 shows a bare terminal blade 60 extending completely through the blade-receiving receptacle 18 of connector 14 to show that a terminal blade of a complementary mating connector can be inserted into receptacle 18 in either opposite direction generally parallel to the circuit board. Of course, terminal blade 60 typically will project outwardly from the remainder of a mating connector.

When connector 14 is mounted to circuit board 22 by means of mounting sections 28 of terminals 24, bottom wall 16*b* of housing 16 is spaced above top surface 22*a* of circuit board 22 as shown by arrows "E" in FIG. 3. Flex sections 30 of terminals 24 provide a yielding flexibility between connector 14 and circuit board 22 to absorb significant stress-creating forces in a direction generally parallel to the circuit board. In addition, as indicated by arrows "B" in FIG. 3, the bottom surfaces 20 of anti-overstress wings 16*d* are spaced an additional distance from the top surface of the circuit board so that if the housing is tilted or otherwise forced too far in directions parallel to the circuit board, the outside bottom corners of the wings will abut against the top surface of the circuit board and prevent any further movement of the connector.

As best seen in FIGS. 2 and 6, bottom wall 16*b* of housing 16 is recessed, as at 62, immediately above mounting sections 28 of terminals 24 to facilitate spacing the housing from the mounting sections.

FIGS. 7–12 show a second embodiment of the invention which is similar to the first embodiment except that housing 16 is wider and has a differently configured receptacle 18 to accommodate differently configured terminals 24. Wherever possible, like reference numerals will be used and applied to the second embodiment in FIG. 7 corresponding to like components of the first embodiment of connector 14 shown in FIGS. 1–6. Where similarities exist, details already described above will not be repeated.

With that understanding, the connector of the second embodiment will be referenced as "14A", and reference will be made directly to FIG. 10 where it can be seen that a pair of terminals 24 again include apertured, plate-like mounting sections 28 for flush mounting connector 14A on top surface 22*a* (FIG. 9) of circuit board 22. Flex sections 30 again join contact sections, generally designated 26, to mounting sections 28 in a generally right-angled configuration, whereby the flex sections, again, perform a dual function of (a) spacing the bottom wall 16*b* of housing 16 from top surface 22*a* of circuit board 22, and (b) providing a yielding flexibility or floating movement between connector 14A and the circuit board.

Figure 11:
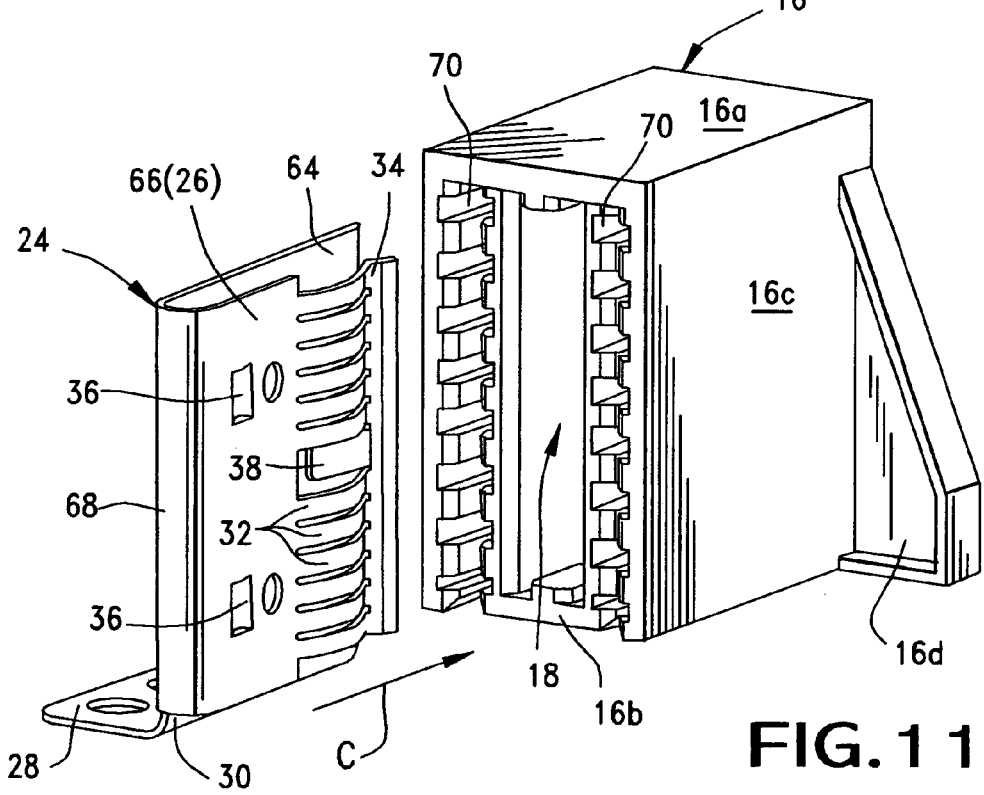
FIG. 11 is a perspective view of the second embodiment, with one of the terminals removed from the housing.
Figure 10:
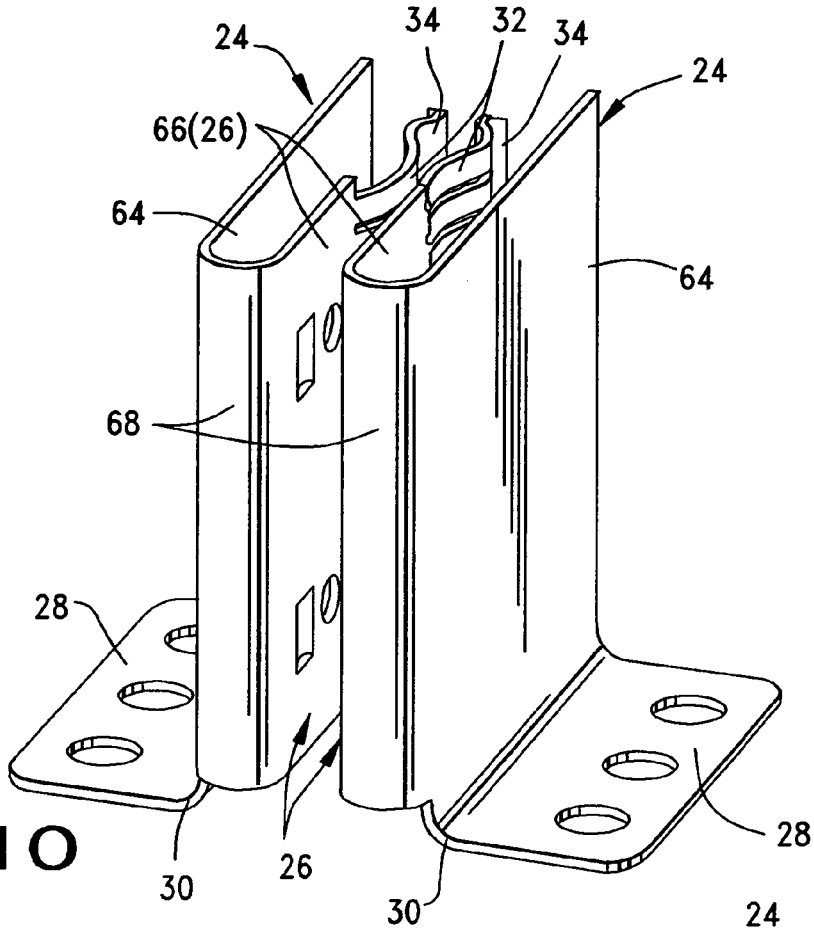
FIG. 10 is a perspective of the two terminals of the second embodiment.
Figure 12:
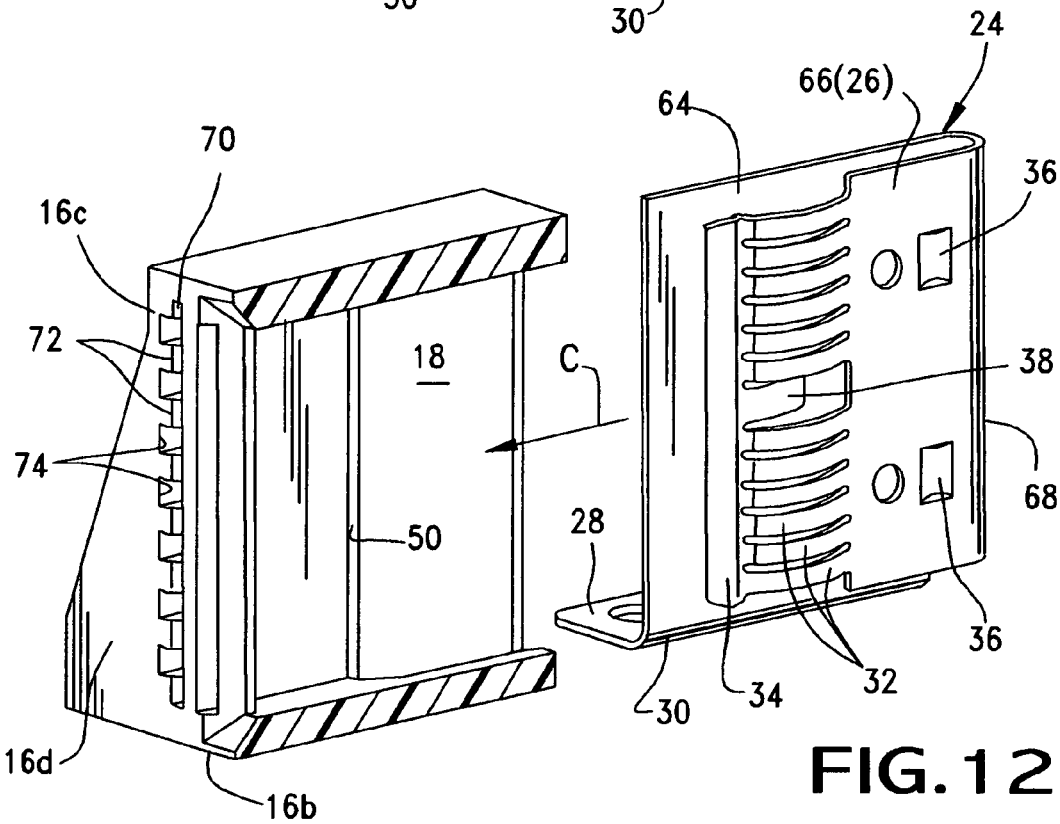
FIG. 12 is a sectioned perspective view along the through receptacle of the second embodiment, with the terminal removed.

Referring particularly to FIGS. 10–12, contact section 26 of each terminal 24 is generally U-shaped in a cross-section generally parallel to the circuit board. The U-shaped configuration defines a pair of legs 64 and 66 (26). As best seen in FIG. 10, leg 64 is a planar plate joined to mounting section 28 by flex section 30. Leg 64 is joined to leg 66 (26) by a curved bight portion 68 to form the U-shaped configuration. In comparing FIGS. 11 and 12 of the second embodiment with FIG. 5 of the first embodiment, it can be seen that leg 66 (26) of the contact section of the terminal in the second embodiment is substantially identical to contact section 26 of the first embodiment. Therefore, like reference numerals will be applied to the like components of contact arm or section 26 in both embodiments, and the descriptions thereof will not be repeated.

Figure 8:
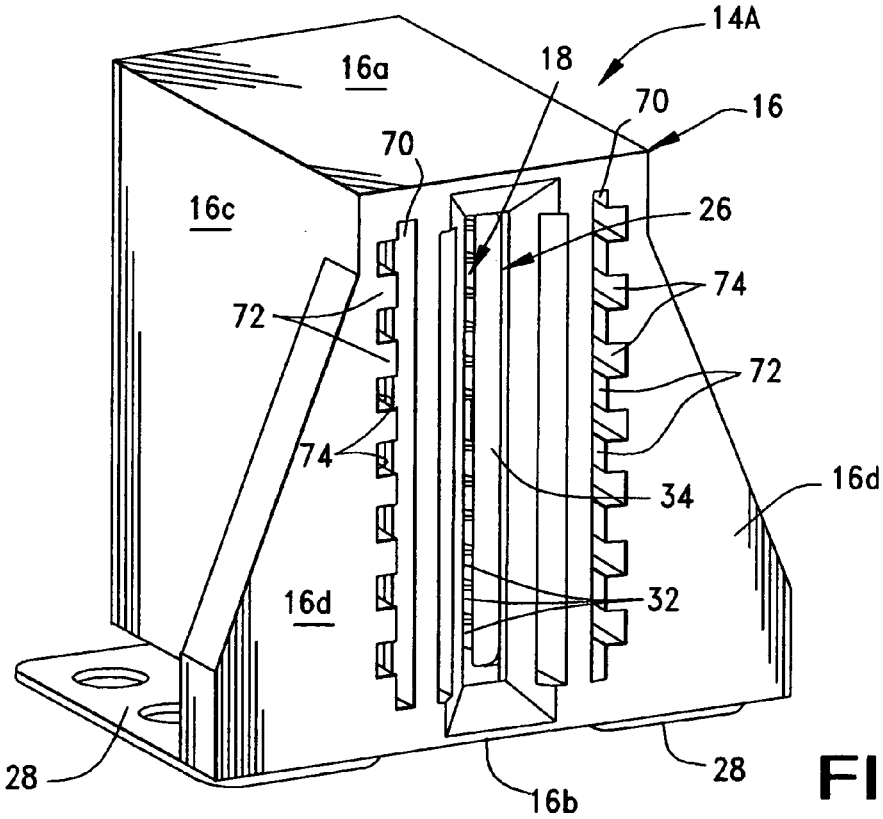
FIG. 8 is a perspective view of the connector in FIG. 7, looking at the opposite side thereof.
Figure 9:
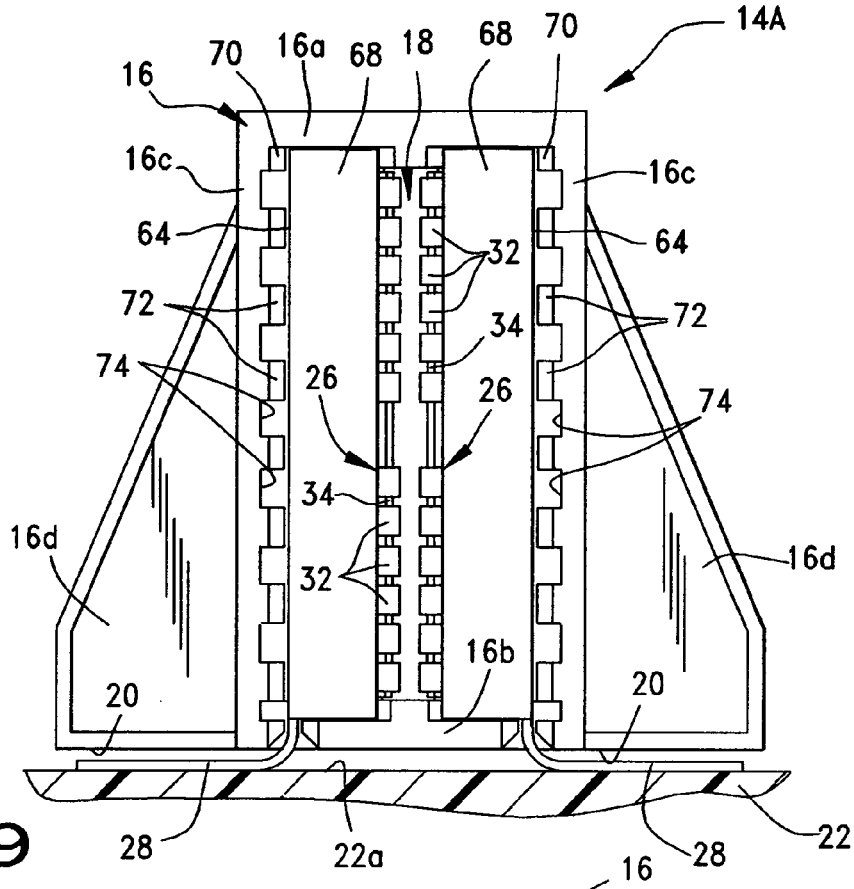
FIG. 9 is a view similar to that of FIG. 3, but of the second embodiment.

Referring to FIGS. 8 and 9 of the second embodiment, housing 16 has a pair of interior grooves 70 which are spaced outwardly of the blade-receiving through receptacle 18. As clearly seen in FIG. 9, flexible contact fingers 32 of contact arms or sections 26 of the second embodiment are disposed at opposite sides of through receptacle 18 just as in the first embodiment.

However, when terminals 24 are mounted in housing 16 in the direction of arrows "C" (FIGS. 11 and 12), plates 64 of the terminals are inserted into interior grooves 70 of housing 16 which are spaced outwardly of through receptacle 18. When fully inserted, latch tabs 38 snap into latching engagement behind latch shoulder 50 in the inside of the through receptacle, just as in the first embodiment.

Finally, a feature of the second embodiment of FIGS. 7–12 is that housing 16 is formed with a plurality of alternating ribs 72 and grooves 74 in the outside surfaces of interior grooves 70. Since connector 14A is a power connector like connector 14, grooves 74 perform a dual function of providing cooling channels to dissipate heat from the power terminals, and the grooves also reduce the thickness of side walls 16*c* of the housing to prevent warping during curing of the molded plastic housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A side-entry board mounted blade-receiving electrical connector, comprising:

a dielectric housing having a bottom wall parallel to and above the board upon which the electrical connector is mounted and a blade-receiving receptacle at a side of the housing; and at least one conductive terminal mounted in the housing and including a contact section exposed within the receptacle for electrically engaging a terminal blade of a complementary mating connecting device inserted into the receptacle in a direction generally parallel to a printed circuit board, a mounting section exposed exteriorly of the housing below the bottom wall thereof for mounting the connector on the printed circuit board, and a flex section joining the mounting section to the contact section and performing a dual function of (a) spacing the bottom wall of the housing above the printed circuit board and (b) providing a yielding flexibility between the connector and the board.

2. The electrical connector of claim 1 wherein the mounting section of said conductive terminal is a plate-like member for flush mounting on a surface of the printed circuit board.

3. The electrical connector of claim 1 wherein said conductive terminal is stamped and formed of sheet metal material.

4. The electrical connector of claim 3 wherein the flex section of said conductive terminal comprises a generally right-angled bend in the terminal between the mounting section and the contact section.

5. The electrical connector of claim 1 wherein the contact section of said conductive terminal is generally U-shaped in a cross-section generally parallel to the printed circuit board, to define a pair of legs joined by a bight portion, one leg being connected to the mounting section of the terminal, and the other leg forming a contact portion of the terminal which engages the terminal blade of the mating connecting device.

6. The electrical connector of claim 1 wherein the bottom wall of said housing is recessed in an area immediately above the mounting section of the conductive terminal.

7. The electrical connector of claim 1 wherein said housing has at least one anti-overstress wing projecting outwardly therefrom above the printed circuit board to prevent over-flexing of the conductive terminals.

8. The electrical connector of claim 1, including a pair of said conductive terminals at opposite sides of the blade-receiving receptacle.

9. The electrical connector of claim 1 wherein said contact section has a plurality of flexible spring fingers for engaging the terminal blade of the mating connecting device.

10. A side-entry board mounted blade-receiving electrical connector, comprising:

a dielectric housing having a bottom wall parallel to and above the board upon which the electrical connector is mounted and a blade-receiving receptacle at a side of the housing; and a pair of conductive terminals mounted in the housing at opposite sides of said blade-receiving receptacle, each terminal being stamped and formed of sheet metal material and including a contact section having a plurality of flexible spring fingers exposed within the receptacle for electrically engaging a terminal blade of a complementary mating connecting device inserted into the receptacle in a direction generally parallel to a printed circuit board, a plate-like mounting section exposed exteriorly of the housing below the bottom wall thereof for flush mounting the connector on a surface of the printed circuit board, and a flex section formed as a right-angled bend in the conductive terminal between the plate-like mounting section and the contact section and performing a dual function of (a) spacing the bottom wall of the housing above the printed circuit board and (b) providing a yielding flexibility between the connector and the board.

11. The electrical connector of claim 10 wherein the contact section of said conductive terminal is generally U-shaped in a cross-section generally parallel to the printed circuit board, to define a pair of legs joined by a bight portion, one leg being connected to the mounting section of the terminal, and the other leg forming a contact portion of the terminal which engages the terminal blade of the mating connecting device.

12. The electrical connector of claim 10 wherein the bottom wall of said housing is recessed in an area immediately above the mounting section of the conductive terminal.

13. The electrical connector of claim 10 wherein said housing has at least one anti-overstress wing projecting outwardly therefrom above the printed circuit board to prevent over-flexing of the conductive terminals.

14. A side-entry electrical connector for mounting on a subjacent support structure, comprising:

a dielectric housing having a bottom wall parallel to and above the subjacent support structure upon which the electrical connector is mounted and a terminal-receiving receptacle at a side of the housing; and at least one conductive terminal mounted in the housing and including a contact section exposed within the receptacle for electrically engaging a terminal of a complementary mating connecting device inserted into the side receptacle in a direction generally parallel to the subjacent structure, a mounting section exposed exteriorly of the housing below the bottom wall thereof for mounting the connector on the subjacent structure, and a flex section joining the mounting section to the contact section and performing a dual function of (a) supporting the bottom wall of the housing spaced above the subjacent structure and (b) providing a yielding flexibility between the connector and the subjacent structure.

15. The electrical connector of claim 14 wherein the mounting section of the conductive terminal is a plate-like member.

16. The electrical connector of claim 14 wherein said conductive terminal is stamped and formed of sheet metal material.

17. The electrical connector of claim 16 wherein the flex section of said conductive terminal comprises a generally right-angled bend in the terminal between the mounting section and the contact section.

18. The electrical connector of claim 14 wherein the bottom wall of said housing is recessed in an area immediately above the mounting section of the conductive terminal.

19. The electrical connector of claim 14 wherein said housing has at least one anti-overstress wing projecting outwardly therefrom above the printed circuit board to prevent over-flexing of the conductive terminals.

20. The electrical connector of claim 14, including a pair of said conductive terminals at opposite sides of the blade-receiving receptacle.

21. A side-entry board mounted blade-receiving electrical connector, comprising:

a dielectric housing having a bottom wall and a blade-receiving receptacle at a side of the housing; and at least one conductive terminal mounted in the housing and including a contact section exposed within the receptacle for electrically engaging a terminal blade of a complementary mating connecting device inserted into the receptacle in a direction generally parallel to a printed circuit board, a mounting section exposed exteriorly of the housing below the bottom wall thereof for mounting the connector on the printed circuit board, and a flex section joining the mounting section to the contact section and performing a dual function of (a) spacing the bottom wall of the housing above the printed circuit board and (b) providing a yielding flexibility between the connector and the board, the contact section of the conductive terminal being generally U-shaped in a cross-section generally parallel to the printed circuit board, to define a pair of legs joined by a bight portion, one leg being connected to the mounting section of the terminal, and the other leg forming a contact portion of the terminal which engages the terminal blade of the mating connecting device.

22. The electrical connector of claim 21 wherein said one leg of the U-shaped contact section is a plate-like member in abutment with the housing, and the other leg of the U-shaped contact section forms a contact arm with portions free to flex toward and away from the one leg.

23. The electrical connector of claim 22 wherein said contact arm has a plurality of flexible spring fingers for engaging the terminal blade of the mating connecting device.

24. The electrical connector of claim 21, including latch means on said other leg for latching the conductive terminal to the housing.

25. The electrical connector of claim 21 wherein said blade-receiving receptacle is a through passage in the housing extending generally parallel to the printed circuit board for receiving a terminal blade of a mating connecting device in either opposite direction of the through passage.

26. A side-entry board mounted blade-receiving electrical connector, comprising:

a dielectric housing having a bottom wall parallel to and above the board upon which the electrical connector is mounted and a blade-receiving receptacle at a side of the housing; and a pair of conductive terminals mounted in the housing at opposite sides of said blade-receiving receptacle, each terminal being stamped and formed of sheet metal material and including a contact section having a plurality of flexible spring fingers exposed within the receptacle for electrically engaging a terminal blade of a complementary mating connecting device inserted into the receptacle in a direction generally parallel to a printed circuit board, a plate-like mounting section exposed exteriorly of the housing below the bottom wall thereof for flush mounting the connector on a surface of the printed circuit board, and a flex section formed as a right-angled bend in the conductive terminal between the plate-like mounting section and the contact section and performing a dual function of (a) spacing the bottom wall of the housing above the printed circuit board and (b) providing a yielding flexibility between the connector and the board, the contact section of the conductive terminal being generally U-shaped in a cross-section generally parallel to the printed circuit board, to define a pair of legs joined by a bight portion, one leg being connected to the mounting section of the terminal, and the other leg forming a contact portion of the terminal which engages the terminal blade of the mating connecting device.

27. The electrical connector of claim 26 wherein said one leg of the U-shaped contact section is a plate-like member in abutment with the housing, and the other leg of the U-shaped contact section forms a contact arm with portions free to flex toward and away from the one leg.

28. The electrical connector of claim 26, including latch means on said other leg for latching the conductive terminal to the housing.

29. The electrical connector of claim 26 wherein said blade-receiving receptacle is a through passage in the housing extending generally parallel to the printed circuit board for receiving a terminal blade of a mating connecting device in either opposite direction of the through passage.

* * * * *